US005129586A

United States Patent [19]

Artemjev et al.

[11] Patent Number: 5,129,586

[45] Date of Patent: Jul. 14, 1992

[54] COMPOUND GRINDING APPARATUS

[76] Inventors: Vladimir K. Artemjev; Sergey Fishel, both of 370 Ft. Washington Ave., Ste. 404, New York, N.Y. 10033

[21] Appl. No.: 617,774

[22] Filed: Nov. 26, 1990

[51] Int. Cl.[5] ..... B02C 19/06

[52] U.S. Cl. ..... 241/5; 241/24; 241/29; 241/79.1; 241/39; 241/119; 241/152.2

[58] Field of Search ..... 241/29, 5, 24, 39, 152 A, 241/117-121, 79.1, 80

[56] References Cited

U.S. PATENT DOCUMENTS 4,489,895 12/1984 Petersen ..... 241/152 A X
4,504,020 3/1985 Nishida et al. ..... 241/152 A X
4,832,268 5/1989 Haddow et al. ..... 241/5
4,889,289 12/1989 Lohnherr et al. ..... 241/152 A X

FOREIGN PATENT DOCUMENTS 2547763 4/1977 Fed. Rep. of Germany ... 241/152 A

*Primary Examiner*—Mark Rosenbaum

[57] ABSTRACT

The compound grinding apparatus comprises a roller mill and rollers, installed in one body and fixed in such a way that they can be rotated relative their own axes of symmetry which are above a slewing table with a rotation drive and a rotating air separator fixed above the roller mill and made in the form of a screened rotor installed inside an impingement ring and equipped with a controlled rotation drive, the unique feature of which is that with the aim of specific power consumption reduction for required grinding degree, capacity increase and improvement of grinding quality it is equipped with a jet grinder with the material circulation units and feed pipelines which end in nozzles elements connected with a pressure source, the jet grinder being mounted between the roller mill and the air separator inside the same body.

2 Claims, 1 Drawing Sheet

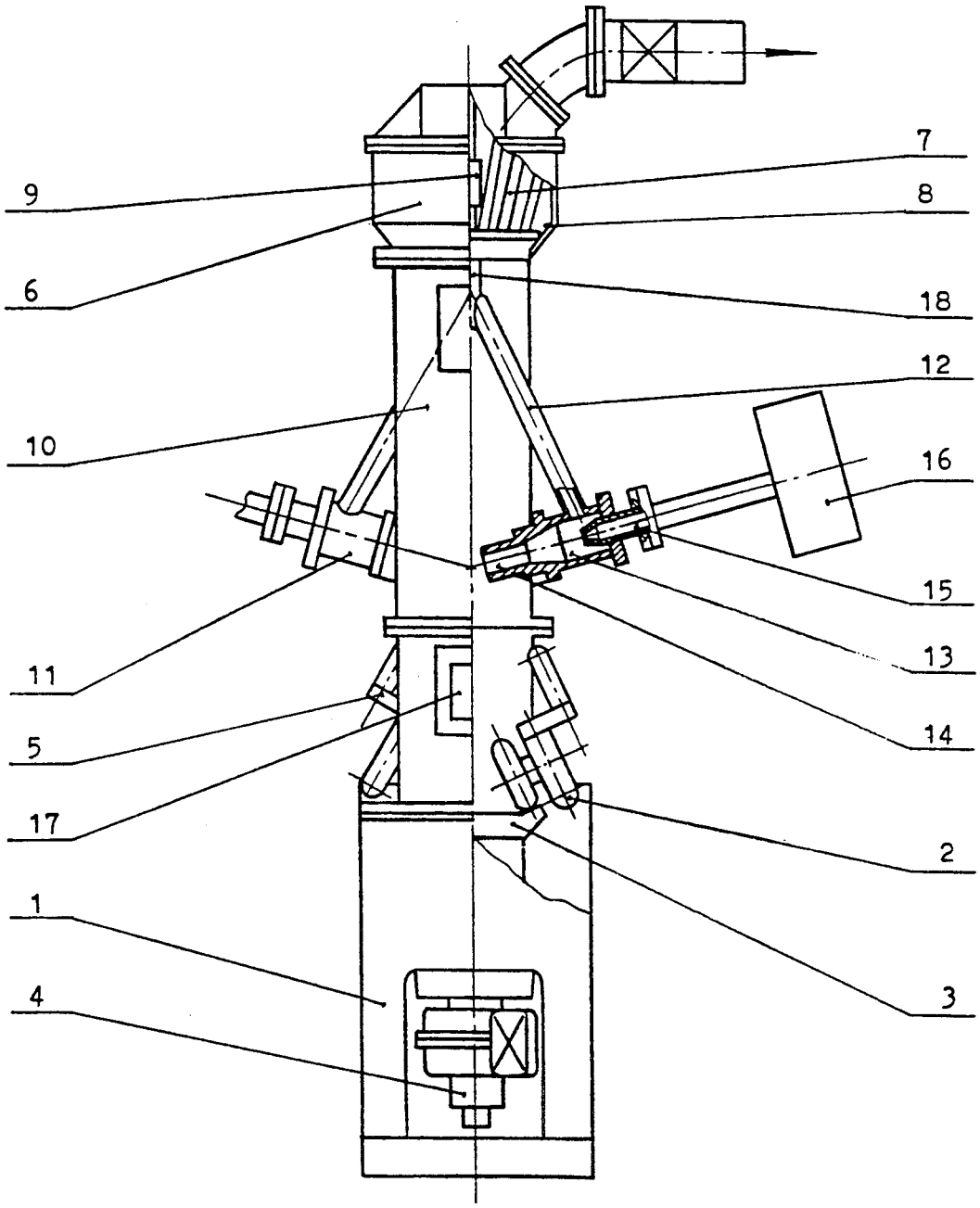
7
9
8
6
18
12
10
16
15
13
11
14
5
17
2
1
3
4

COMPOUND GRINDING APPARATUS

BACKGROUND OF THE INVENTION

The present invention relates to a range of vertical roller mills and it comprises a roller mill with rollers, installed within one body and fixed in such a way that they can be rotated relative their own axes of symmetry, which are above a slewing table with a rotation drive and rotating air separator fixed above the roller mill and made in the form of a screened rotor installed inside an impingement ring and equipped with a controlled rotating drive. The initial particle size can be from several millimeters up to 100–150 millimeters.

Practical results achieved during operation of the range of vertical mills has confirmed that technical capabilities of the grinding equipment are practically exhausted and their technical characteristics are limited in dispersity increase of processed materials, reduction of specific power consumption and lack of ability to produce fine dispersity final products of given grain size distribution.

During processing of materials of higher dispersity, such events as vibration increase, number of particle circulations within a mill increases, level of roller wear-out grows, the ground material structure reaches monostructure by obtaining specific particles geometry which is typical for this type of grinding.

Infringement of rational grinding mode leads to unjustified high power consumption per unit of product and therefore cost of mills and grinding process itself.

SUMMARY OF THE INVENTION

The object of the present invention is to eliminate the shortcomings which have been mentioned due to change of the material grains grinding type which are circulating inside the mill, reduce specific power consumption, increase grinding quality, increase the mill output capacity without changing specific metal volume and reduction of the mill operational reliability.

The object is achieved because the compound grinding apparatus in which the basic elements of roller mill are used is equipped with a supersonic jet stream grinder which is mounted within the mill body between rollers and a classifier and the mill free area and volume are used as a collision zone and a chamber of the energy carrier supersonic streams which deliver material after its processing in rollers and classifier. It makes possible to operate the mill in efficient mode of the roller grinding and carry out additional fine grinding of the material inside the jet grinder after the material classification thus one apparatus performs two different types of grinding.

The selection of rational grinding modes combining roller and jet stream results in lower power consumption, the mill output capacity increases due to the reduced number of circulation cycles and production of polydispersity final products of the higher quality.

The new effect is not just a result of simple combination of each grinding equipment type positive qualities but is achieved due to the invention of the higher technical level grinding apparatus of a new type.

The jet and roller grinders installation in a single body helps to reduce and entirely excludes the necessity to introduce the energy source (power gas from a pressure source) in the rollers installation area for liquidation and carrying away of the processed material. This function is carried out by the energy source which is connected to the jet grinder nozzles. It should be noted that simple successive connection of the aforementioned units does not achieve the aforementioned effect. The other component which provides the energy economy, is preparation of the material for grinding due to the collision of particles with the roller during discharge from the jet grinder. It helps to increase the grinding quality due to the third method of grinding (impact) and it is one of the factors to lower the number of the material circulations and thus consequently increase capacity and reduce energy consumption. The other factor which reduces the number of circulations and energy consumption is the combination of two different grinding methods in a single apparatus, at the same time, unlike simple return of the material after separation, the return of it in the given technical solution is carried out through circulation units by hitting the grinding area of the jet apparatus and by reaching of the required particles area during 1–2 circulations instead of multiple circulation process.

DETAILED DESCRIPTION OF THE INVENTION

The essence of the invention is explained by the drawing where the claimed apparatus longitudinal cross-section is shown.

The apparatus comprises a roller mill 1 and rollers 2, inside the mill and the rollers are fixed in such a way that they can be rotated relative their own axes of symmetry. The rollers are mounted above a sewing table 3 with a rotation drive 4. The roller mill is installed inside a body 5. Above the body 5 a rotating air separator 6 is fit which is made in the form of a screened rotor 7 installed inside an impingement ring 8 and equipped with a controller drive 9. Between the roller mill 1 and the air separator 6 within the same body 5 there is a jet grinder 10 which is equipped with four units for material circulation 11 with feed pipelines 12 which end in mixing chambers 13 with acceleration pipes 14. Within the chambers 13 power gas nozzles 15 are fitted which ar fixed with a pressure source 16. There is a loading hopper 17 which is installed at the level of the roller mill 1 within the body 5. Above the acceleration pipes 14 within the body 5 there is material collector 18 which is made in the form of a collecting bowl connected with the circulation units 11 by means of the feed pipelines 12.

The apparatus is operated in the following way: The initial material is fed through the loading hopper 17 into the roller mill 1. From the pressure source 16 gas is fed into the power gas nozzles 15 and the drive 4 of the slewing table 3 of the roller mill 1 will be cut in. The material destruction due to the rollers 2 action takes place. The gas steam picks up the ground particles and means them away into the separator 6 area. The rotor 7 of the separator 6 is rotating within the impingement ring 8 by means of the controlled drive 9. Fine fractions are taken away through the separator 6 into the cyclone for the final product separation and course fractions drop down into the units for material circulation 11 (there re four units and they are operated in pairs—one per each side) and through the feed pipelines 12 they are conveyed into the mixing chambers 13. Further the particles are pumped by the power gas from the nozzles 15 and after being fed up in the acceleration pipes 14 up to the required speed values begin to grind due to mutual collision of oncoming streams within the body 5.

The resultant of the oncoming steams is directed downwards the roller mill 1. Due to collision with the roller 2 the particles are ground additionally and appear on the roller mill 1 table. The up-current stream feeds the particles of defined size into the rotating separator 6 and the grinding cycle will be repeated. It is possible to carry out continuous feed of new material into the apparatus. It can be achieved with the help of a valve or an auger conveyor (it is not shown at the drawing. In the case when the auger conveyor is used, the valve function is performed by the auger flange.).

It will be appreciated that the instant specification and claims are set forth by way of illustrative and not limitation, and that various modifications and changes may be made without departing from the spirit and scope of the present invention.

What is claimed is:

1. A method of producing fine dispersity, solid crystalline materials of improved reactivity due to the grain size distribution control, mechanical activities and different types of grinding including the following steps of:

feeding the solid crystalline material to a vertical roller mill for primary crushing;

crushing the solid crystalline material in the vertical roller mill during operational mode of maximum deformation and destruction of the material;

delivering by an air stream of the crushed and deformed solid crystalline material to a classifier for the material separation, according to the required particle size;

delivering the coarse particles of the solid crystalline material from the classifier to a jet mill;

grinding the coarse particles of the solid crystalline material in the jet mill to form a fine solid crystalline material of the required grain size distribution, particle size, and improved reactivity.

2. A compound grinding apparatus for solid crystalline material fine grinding comprising:

a vertical roller mill provided with rollers and a slewing table with a drive which are arranged within a grinding chamber;

a classifier of turbine-type with adjustable blades through which the final product is delivered in a filter system and a final product site;

a tailings cone hopper and transportation means for the tailing delivery to a jet mill;

the jet mill which is equipped with chamber pumps and acceleration pipes with supersonic nozzles which are combined by a grinding chamber;

means for final product pneumatic delivery to a filter system and a final product silo.

* * * * *